US012702195B2

(12) United States Patent
Bailly et al.

(10) Patent No.: US 12,702,195 B2
(45) Date of Patent: Aug. 11, 2026

(54) SOLE STRUCTURE FOR ARTICLE OF FOOTWEAR

(71) Applicant: NIKE, Inc., Beaverton, OR (US)

(72) Inventors: Devin Bailly, Portland, OR (US); Paul Begyn, Beaverton, OR (US); Clayton Chambers, Portland, OR (US); Guercy Eugene, Portland, OR (US); Dervin A. James, Hillsboro, OR (US); Jason R. Meeker, Portland, OR (US); Benjamin J. Monfils, Portland, OR (US); Kevin C. Sze, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/977,069

(22) Filed: Dec. 11, 2024

(65) Prior Publication Data

US 2025/0185755 A1 Jun. 12, 2025

Related U.S. Application Data

(60) Provisional application No. 63/609,209, filed on Dec. 12, 2023.

(51) Int. Cl.
*A43B 13/20* (2006.01)
*A43B 13/18* (2006.01)

(52) U.S. Cl.
CPC ..... *A43B 13/20* (2013.01); *A43B 13/186* (2013.01)

(58) Field of Classification Search
CPC ..... A43B 13/20; A43B 13/186; A43B 13/122; A43B 13/125; A43B 13/16; A43B 7/144
See application file for complete search history.

(56) References Cited

U.S. PATENT DOCUMENTS

| | | | | |
|---|---|---|---|---|
| 11,026,476 | B2 * | 6/2021 | Eldem | A43B 21/26 |
| 11,058,174 | B2 * | 7/2021 | Hale | A43B 13/20 |
| 11,805,845 | B2 | 11/2023 | Hale | |
| 12,250,987 | B2 * | 3/2025 | Eldem | A43B 13/189 |
| 2017/0265566 | A1 * | 9/2017 | Case | A43B 13/186 |
| 2019/0200700 | A1 * | 7/2019 | Hale | A43B 13/127 |
| 2022/0378148 | A1 * | 12/2022 | Eldem | A43B 3/0063 |
| 2023/0189925 | A1 | 6/2023 | Andreasen et al. | |
| 2023/0189926 | A1 * | 6/2023 | Hardman | A43B 13/186 36/29 |

FOREIGN PATENT DOCUMENTS

WO WO-2024137581 A1 6/2024

OTHER PUBLICATIONS

European Patent Office (ISA), International Search Report and Written Opinion for PCT App. No. PCT/US2024/059748, mailed Mar. 17, 2025.

* cited by examiner

*Primary Examiner* — Haley A Smith
(74) *Attorney, Agent, or Firm* — Honigman LLP; Matthew H. Szalach

(57) ABSTRACT

A sole structure for an article of footwear defines a footbed and includes a bladder extending from a first end in a forefoot region of the sole structure to a second end in a heel region of the sole structure and a chassis including a lower chassis having a first outsole segment attached to the bladder in the forefoot region and a lower cushioning element attached to the bladder in the heel region.

20 Claims, 10 Drawing Sheets

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/609,209, filed on Dec. 12, 2023. The disclosure of this prior application is considered part of the disclosure of this application and is hereby incorporated by reference in its entirety.

FIELD

The present disclosure relates generally to a sole structure for an article of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
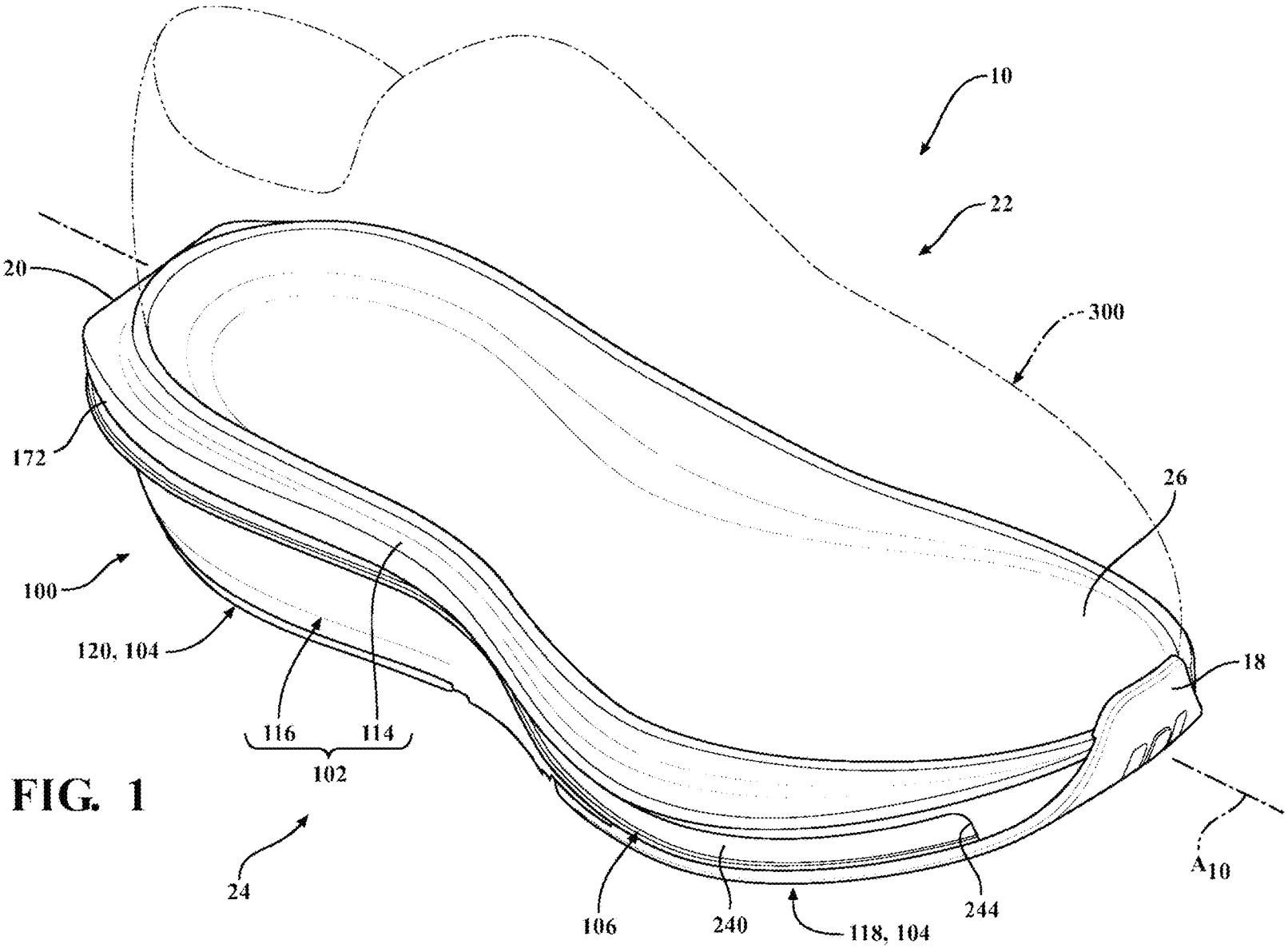
FIG. 1 is a lateral side perspective view of an article of footwear including an example of a sole structure in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear includes a bladder extending from a first end in a forefoot region of the sole structure to a second end in a heel region of the sole structure and a chassis including a lower chassis having a first outsole segment attached to the bladder in the forefoot region and a lower cushioning element attached to the bladder in the heel region.

The sole structure may include one or more of the following optional features. For example, the lower chassis may define an upper chassis surface extending continuously from the forefoot region to the heel region and may support the bladder. A first portion of the upper chassis surface may be defined by the first outsole segment and a second portion of the upper chassis surface may be defined by the lower cushioning element.

In one configuration, the lower cushioning element may include a lateral joint connecting the lower cushioning element to the first outsole segment. The lateral joint may be disposed between the forefoot region and a mid-foot region of the sole structure. Additionally or alternatively, the lower cushioning element may overlap the first outsole segment along the lateral joint.

The bladder may include a first curved portion in a forefoot region of the sole structure and a substantially flat portion in the heel region of the sole structure. Additionally or alternatively, the chassis may include an upper chassis disposed on an opposite side of the bladder from the lower chassis.

In another configuration, a sole structure for an article of footwear is provided and includes a lower chassis having a first outsole segment defining a first portion of an upper chassis surface in a forefoot region of the sole structure and a lower cushioning element attached to the first outsole segment and defining a second portion of the upper chassis surface in at least one of a mid-foot region and a heel region of the sole structure and a bladder supported on the upper chassis surface and extending from a first end in the forefoot region of the sole structure to a second end in the heel region of the sole structure.

The sole structure may include one or more of the following optional features. For example, the upper chassis surface may extend continuously from the forefoot region to the heel region and may support the bladder. The lower cushioning element may include a lateral joint connecting the lower cushioning element to the first outsole segment. The lateral joint may be disposed between the forefoot region and the mid-foot region of the sole structure. The lower cushioning element may overlap the first outsole segment along the lateral joint.

In one configuration, the bladder may include a first curved portion in the forefoot region of the sole structure and a substantially flat portion in the heel region of the sole structure. Additionally or alternatively, an upper chassis may be disposed on an opposite side of the bladder from the lower chassis.

In yet another configuration, a sole structure for an article of footwear is provided and includes a first outsole segment having a first side defining a first portion of an upper chassis surface in a forefoot region of the sole structure and a second side formed on an opposite side from the first side and defining a first portion of a ground-contacting surface of the sole structure, a lower cushioning element attached to the first outsole segment and having (i) a third side defining a second portion of the upper chassis surface in at least one of a mid-foot region and a heel region and (ii) a fourth side formed on an opposite side of the lower cushioning element from the third side, and a bladder supported on the upper chassis surface and extending from a first end in the forefoot region of the sole structure to a second end in one of the mid-foot region or the heel region of the sole structure.

The sole structure may include one or more of the following optional features. For example, the upper chassis surface may extend continuously from the forefoot region to the heel region and may support the bladder. The lower cushioning element may include a lateral joint connecting the lower cushioning element to the first outsole segment.

In one configuration, an upper cushioning element may be disposed on an opposite side of the bladder from the lower cushioning element and the first outsole segment. A second outsole segment may be attached to the fourth side of the lower cushioning element and may define a second portion of the ground-contacting surface of the sole structure in the heel region.

Figure 3A:
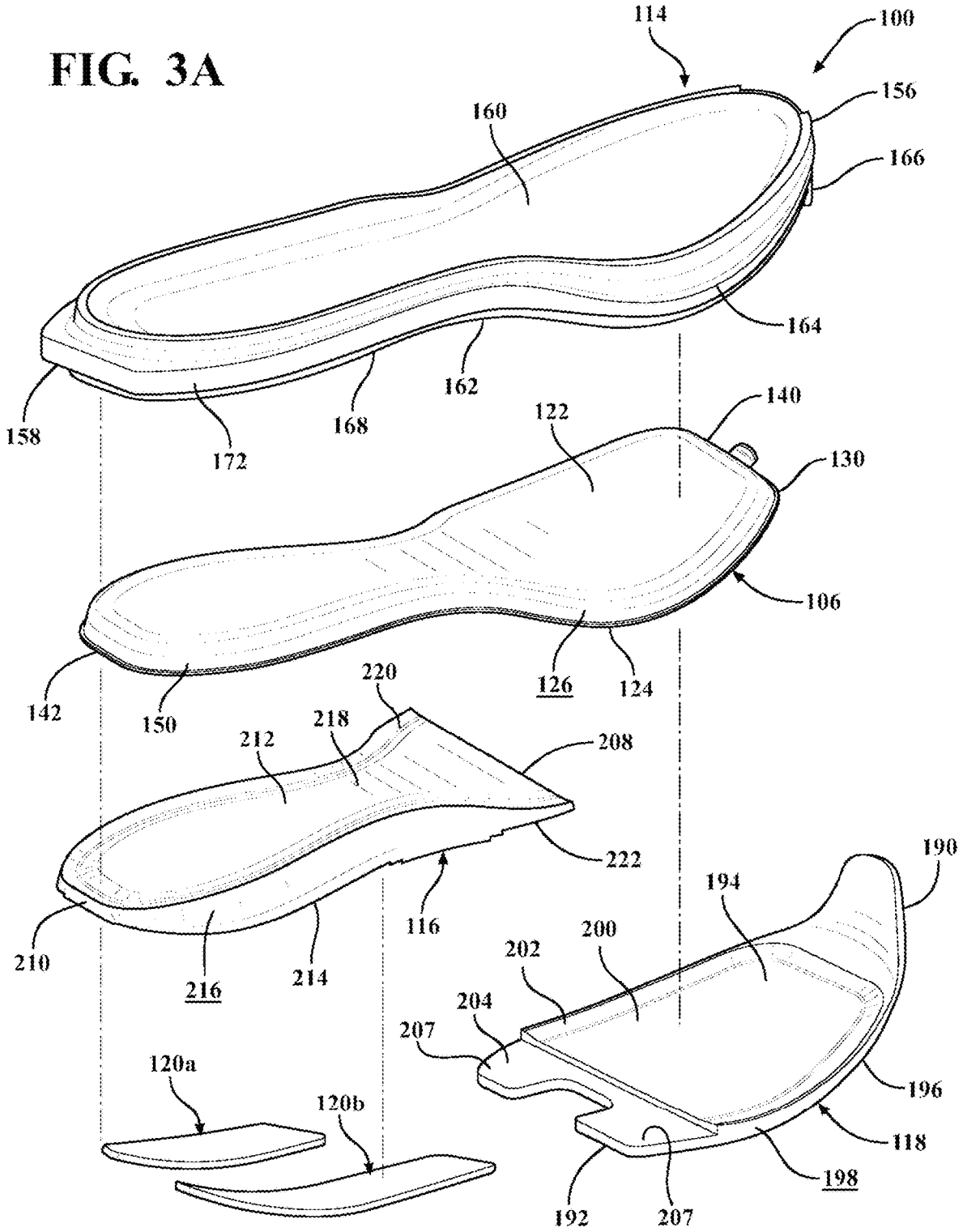
FIG. 3A is a top perspective, fully exploded view of the sole structure of FIG. 1.
Figure 3B:
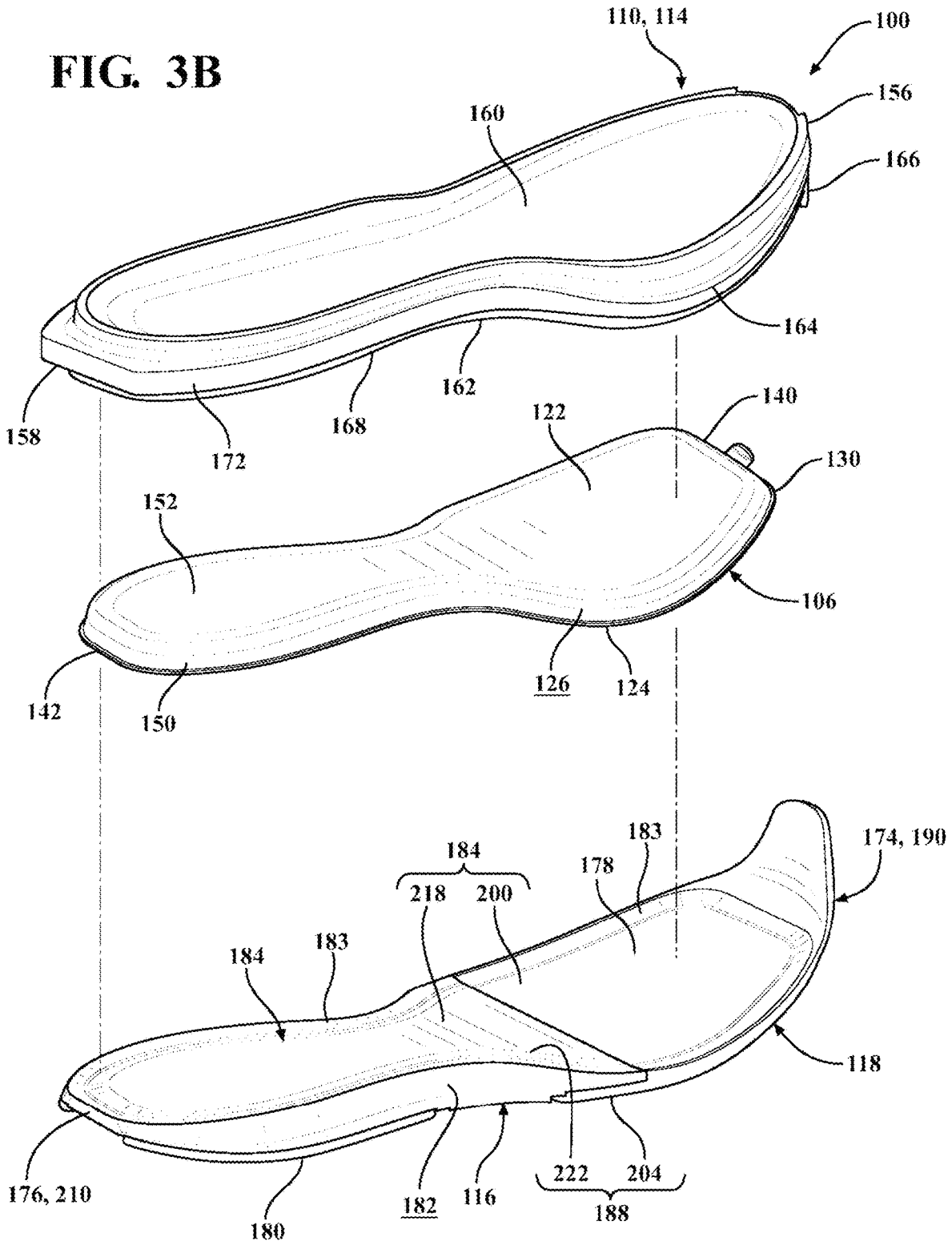
FIG. 3B is a top perspective, partially exploded view of the sole structure of FIG. 1.
Figure 4:
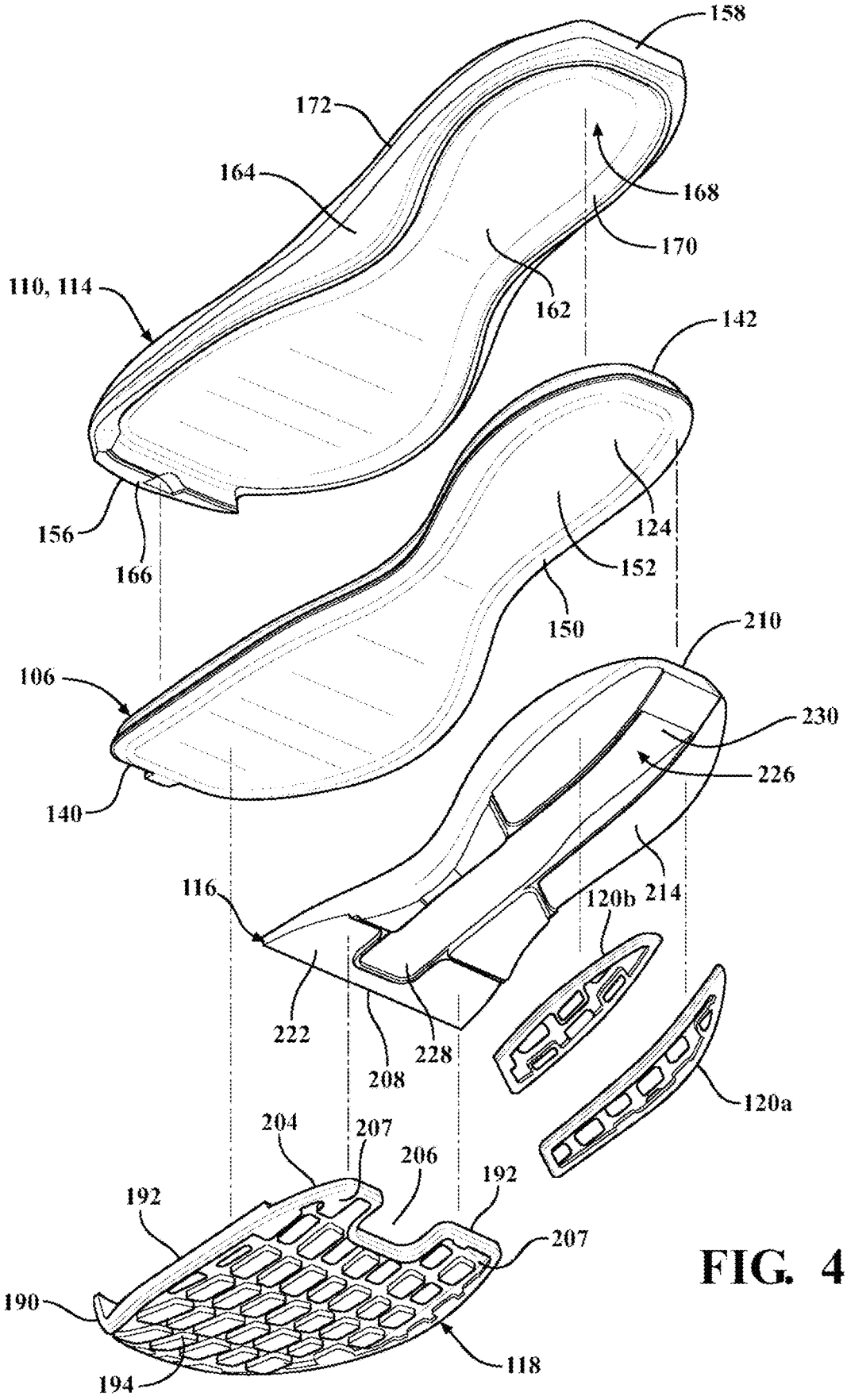
FIG. 4 is a bottom perspective exploded view of the sole structure of FIG. 1.
Figure 5:
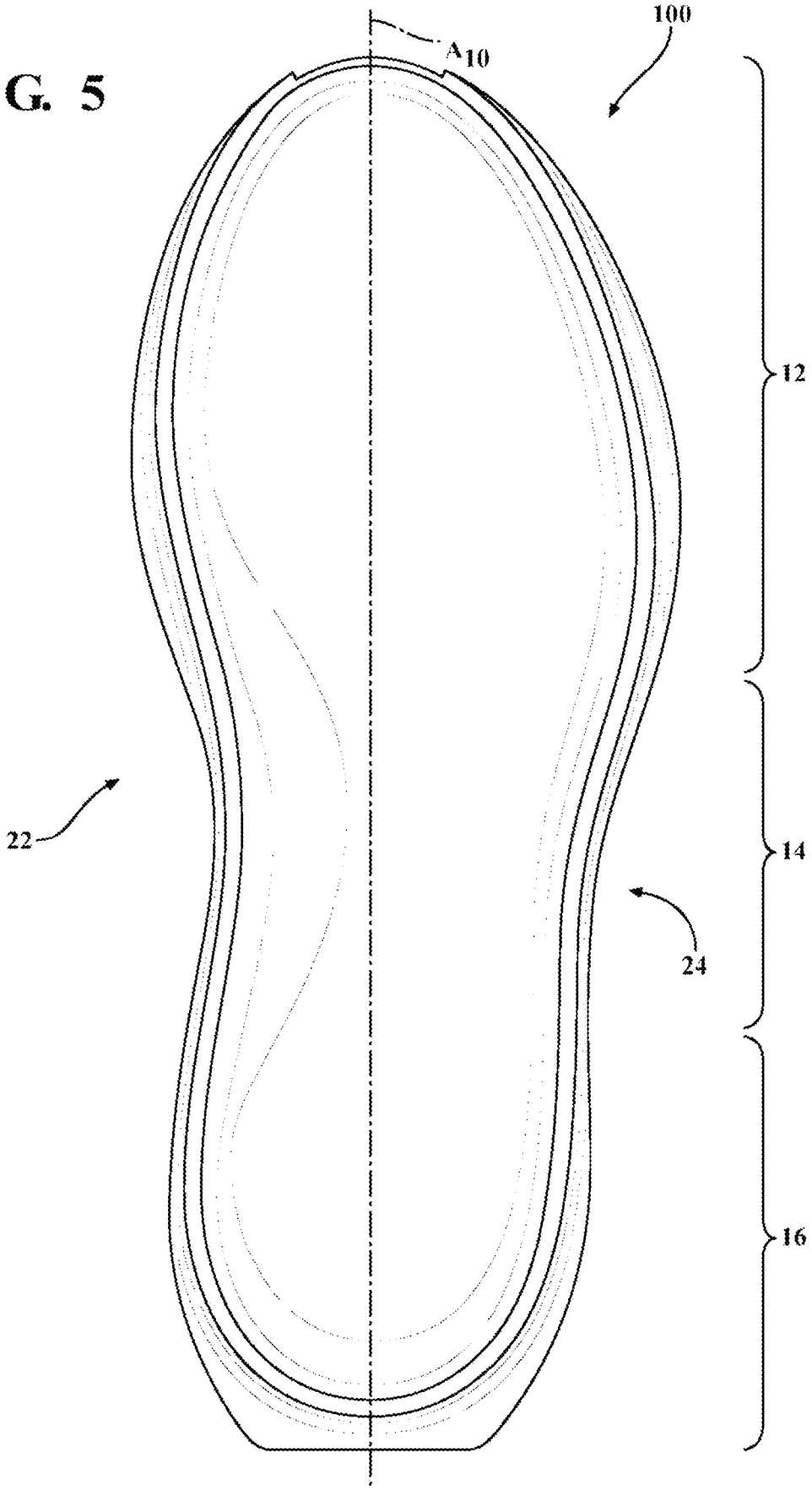
FIG. 5 is a top plan view of the sole structure of FIG. 1.
Figure 6:
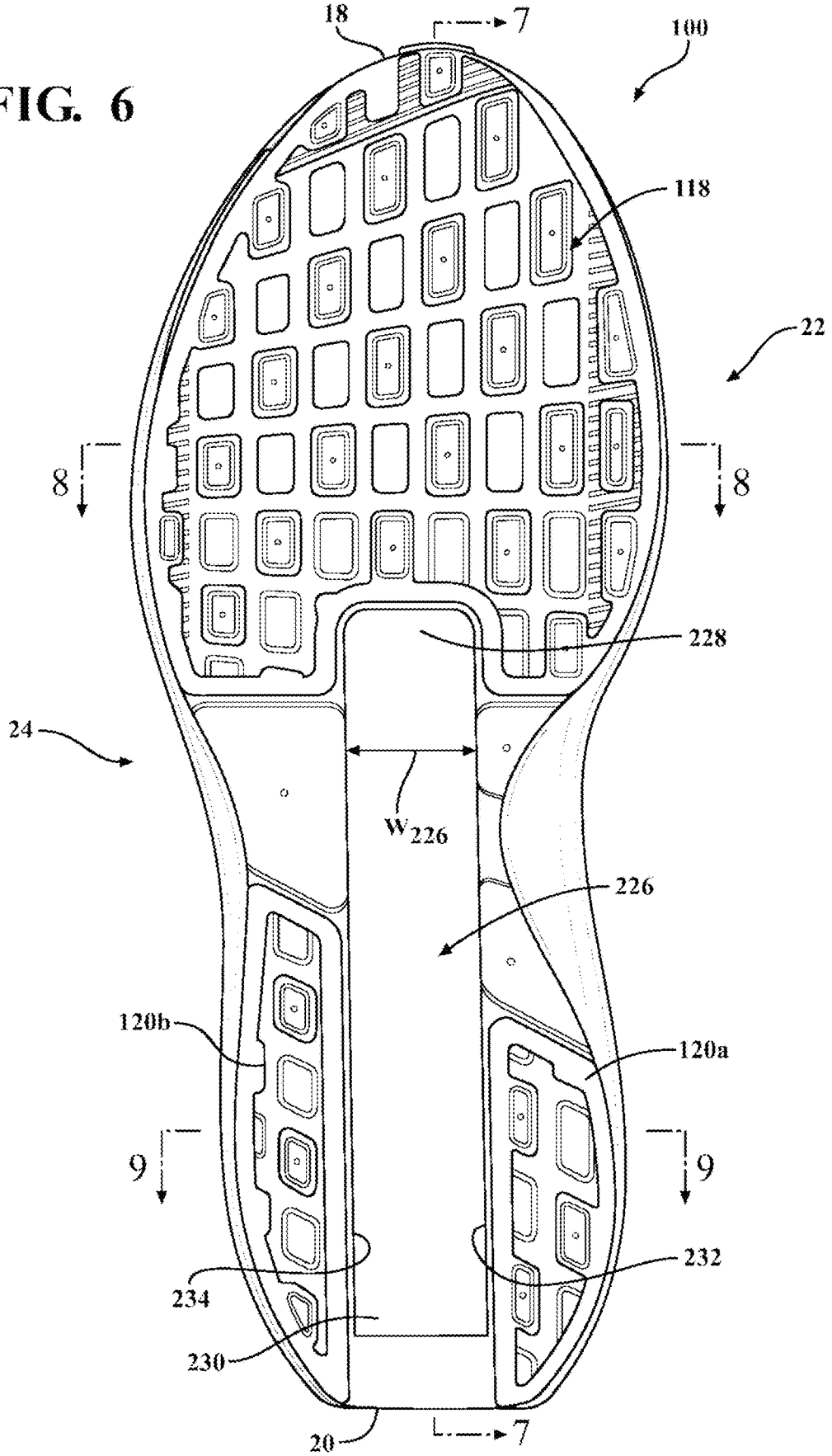
FIG. 6 is a bottom plan view of the sole structure of FIG. 1.
Figure 7:
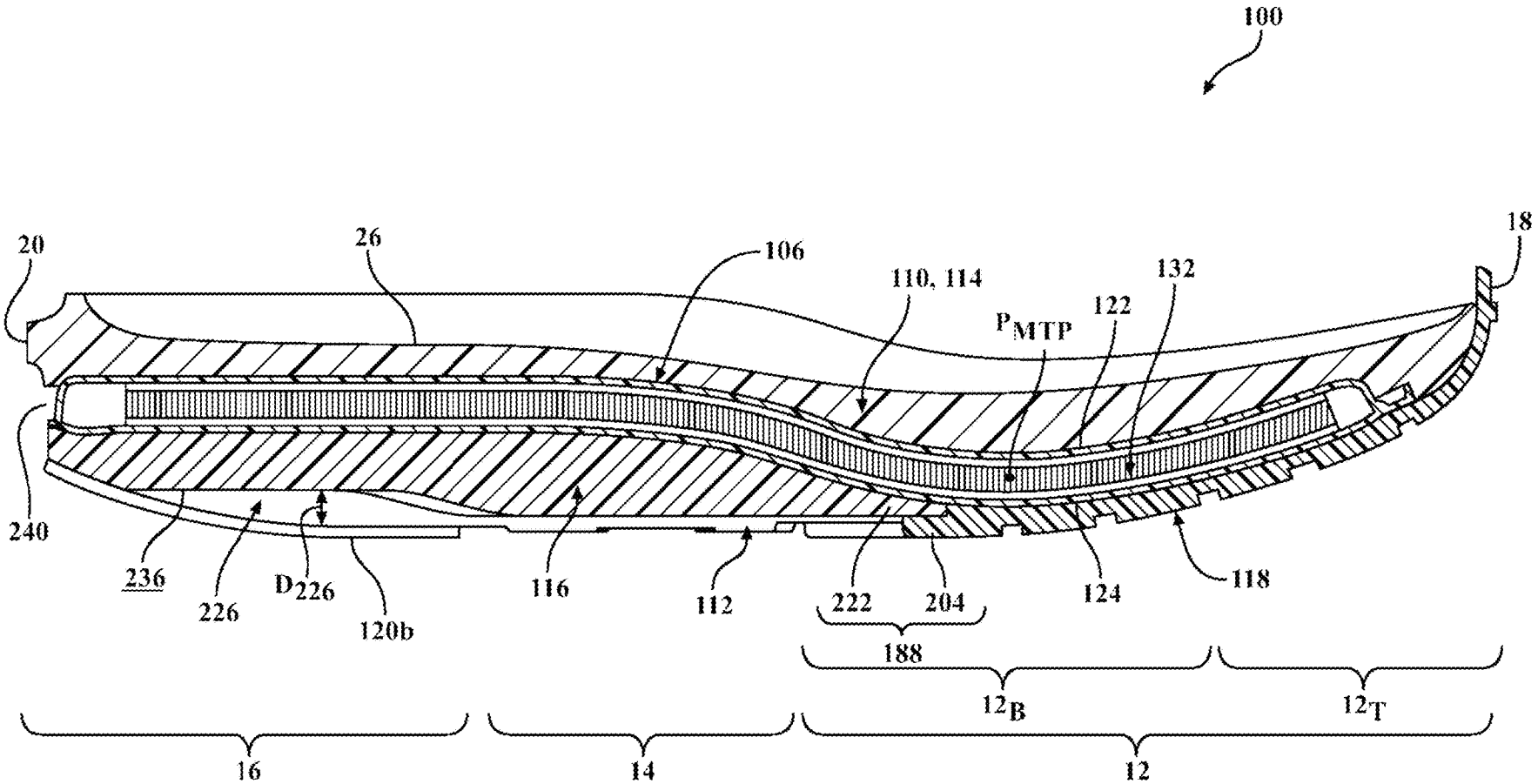
FIG. 7 is a longitudinal cross-sectional view of the sole structure of FIG. 1, taken along Line 7-7 of FIG. 6.

Referring to FIGS. 1-9, an article of footwear 10 is provided, which includes a sole structure 100 and an upper 300 attached to the sole structure 100. The article of footwear 10 may be divided into one or more regions. The regions may include a forefoot region 12, a mid-foot region 14, and a heel region 16. As best shown in FIG. 7, the forefoot region 12 may include a toe portion $\mathbf{12}_T$ corresponding to the phalanges and a ball portion $\mathbf{12}_B$ corresponding to the metatarsophalangeal joint (i.e., "the ball") of the foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a medial side 22 and a lateral side 24, as shown in FIG. 5. Accordingly, the medial side 22 and the lateral side 24 respectively correspond with opposite sides of the footwear 10 and extend through the regions 12, 14, 16.

With reference to FIGS. 1-4, the sole structure 100 includes a midsole 102 configured to provide cushioning characteristics to the sole structure 100, and an outsole 104 configured to provide a ground-contacting surface 28 of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 may be described as including a bladder 106 and a chassis 108, where the chassis 108 is configured to be attached to the upper 300 and provides an interface between the upper 300 and the bladder 106. In the illustrated example, the bladder 106 is supported within the chassis 108 between an upper chassis 110 and a lower chassis 112, which are described in greater detail below.

Generally, the bladder 106 of the sole structure 100 is supported within the chassis 108 and is configured to attenuate forces associated with impacts along the length of the foot. The bladder 106 of the midsole 102 includes an opposing pair of barrier layers 122, 124, which are joined to each other along a peripheral seam 130 to define a chamber 128. In the illustrated configuration, the barrier layers 122, 124 include a first, upper barrier layer 122 defining an upper surface of the bladder 106 and a second, lower barrier layer 124 defining a lower surface of the bladder 106. Alternatively, the chamber 128 can be produced from any suitable combination of one or more barrier layers, as described in greater detail below.

As used herein, the term "barrier layer" (e.g., barrier layers 122, 124) encompasses both monolayer and multilayer films. In some embodiments, one or both of barrier layers the 122, 124 are each produced (e.g., thermoformed or blow molded) from a monolayer film (a single layer). In other embodiments, one or both of the barrier layers 122, 124 are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 122, 124 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 122, 124 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 122, 124 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 122, 124 include two or more sublayers, examples of suitable multilayer films include microlayer films, such as those disclosed in Bonk et al., U.S. Pat. No. 6,582,786, which is incorporated by reference in its entirety. In further embodiments, barrier layers 122, 124 may each independently include alternating sublayers of one or more TPU copolymer materials and one or more EVOH copolymer materials, where the total number of sublayers in each of the barrier layers 122, 124 includes at least four (4) sublayers, at least ten (10) sublayers, at least twenty (20) sublayers, at least forty (40) sublayers, and/or at least sixty (60) sublayers.

The bladder 106 can be produced from the barrier layers 122, 124 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 122, 124 can be produced by co-extrusion followed by vacuum thermoforming to produce an inflatable bladder 106, which can optionally include one or more valves (e.g., one way valves) that allows the chamber 128 to be filled with the fluid (e.g., gas).

The chamber 128 can be provided in a fluid-filled (e.g., as provided in footwear 10) or in an unfilled state. The chamber 128 can be filled to include any suitable fluid, such as a gas or liquid. In an aspect, the gas can include air, nitrogen ($N_2$), or any other suitable gas. In other aspects, the chamber 128 can alternatively include other media, such as pellets, beads, ground recycled material, and the like (e.g., foamed beads and/or rubber beads). The fluid provided to the chamber 128 can result in the chamber 128 being pressurized. Alternatively, the fluid provided to the chamber 128 can be at atmospheric pressure such that the chamber 128 is not pressurized but, rather, simply contains a volume of fluid at atmospheric pressure.

The bladder 106 desirably has a low gas transmission rate to preserve its retained gas pressure. In some embodiments, the bladder 106 has a gas transmission rate for nitrogen gas that is at least about ten (10) times lower than a nitrogen gas transmission rate for a butyl rubber layer of substantially the same dimensions. In an aspect, bladder 106 has a nitrogen gas transmission rate of 15 cubic-centimeter/square-meter·atmosphere·day ($cm^3/m^2$·atm·day) or less for an average film thickness of 500 micrometers (based on thicknesses of the barrier layers 122, 124). In further aspects, the transmission rate is 10 $cm^3/m^2$·atm·day or less, 5 $cm^3/m^2$·atm·day or less, or 1 $cm^3/m^2$·atm·day or less.

In some implementations, the upper barrier layer 122 and the lower barrier layer 124 cooperate to define a geometry (e.g., thicknesses, width, and lengths) of the chamber 128. For example the peripheral seam 130 may bound and extend around the chamber 128 to seal the fluid (e.g., air) within the chamber 128. Thus, the chamber 128 is associated with an area of the bladder 106 where interior surfaces of the upper and lower barrier layers 122, 124 are not joined together and, thus, are separated from one another. In the illustrated example, the bladder 106 includes a peripheral surface 126 that defines a peripheral profile of the bladder 106 and extends between a top surface defined by the upper barrier layer 122 and a bottom surface defined by the lower barrier layer 124.

Figure 8:
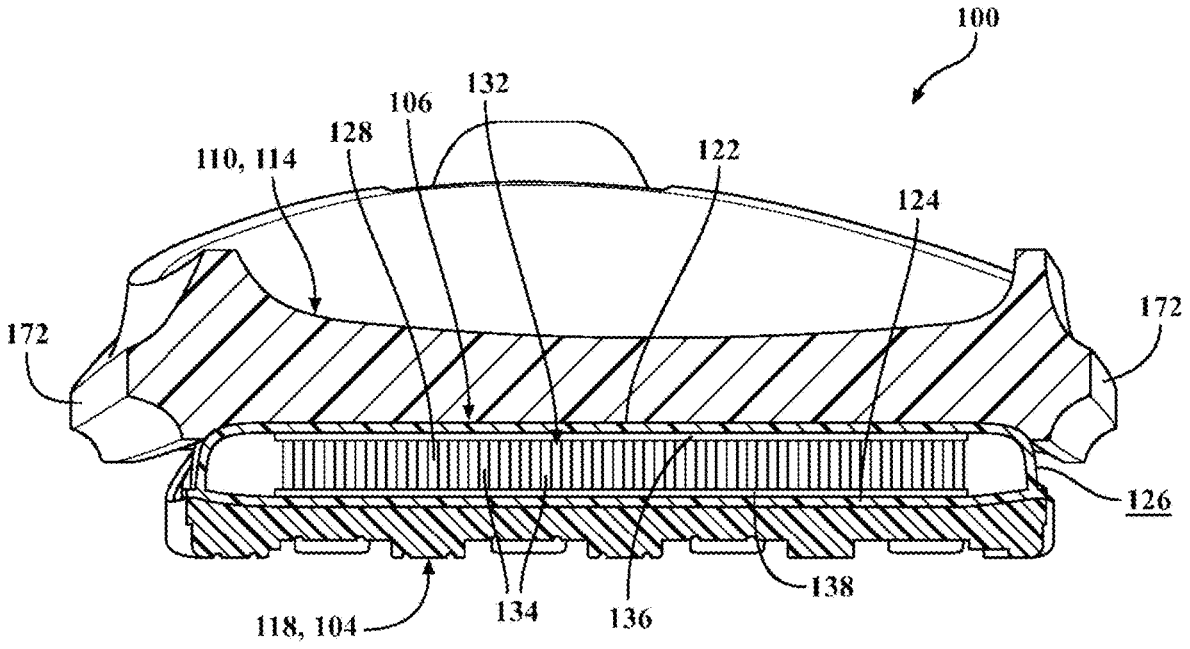
FIG. 8 is a lateral cross-sectional view of the sole structure of FIG. 1, taken along Line 8-8 of FIG. 6.
Figure 9:
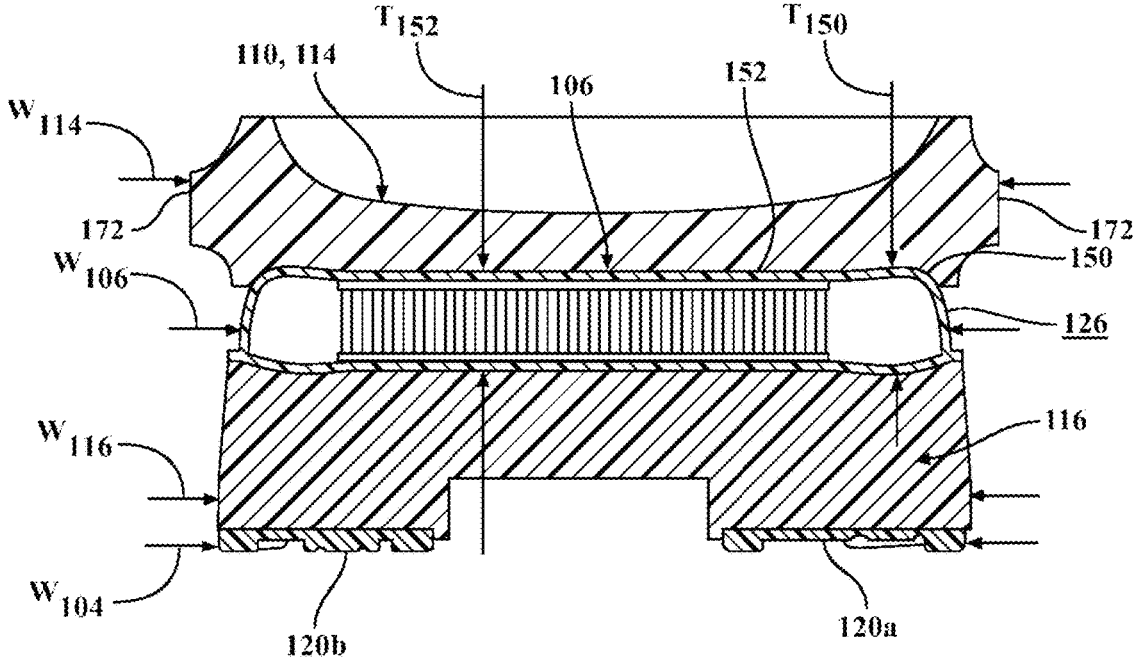
FIG. 9 is a lateral cross-sectional view of the sole structure of FIG. 1, taken along Line 9-9 of FIG. 6.

As shown in FIGS. 7-9, a space formed between opposing interior surfaces of the upper and lower barrier layers 122, 124 defines an interior void of the chamber 128. Similarly, exterior surfaces of the upper and lower barrier layers 122, 124 define an exterior profile of the chamber 128. Thicknesses of the chamber 128 are defined by the distance between the upper and lower barrier layers 122, 124 of the bladder 106.

The interior void of the chamber 128 may receive a tensile element 132 therein. The tensile element 132 may include a series of tensile strands 134 extending between an upper tensile sheet 136 and a lower tensile sheet 138. The upper tensile sheet 136 may be attached to the upper barrier layer 122 while the lower tensile sheet 138 may be attached to the lower barrier layer 124. In this manner, when the chamber 128 receives a pressurized fluid, the tensile strands 134 of the tensile element 132 are placed in tension. Because the upper tensile sheet 136 is attached to the upper barrier layer 122 and the lower tensile sheet 138 is attached to the lower barrier layer 124, the tensile strands 134 retain a desired shape of the chamber 128 when the pressurized fluid is injected into the interior void of the chamber 128.

Figure 10:
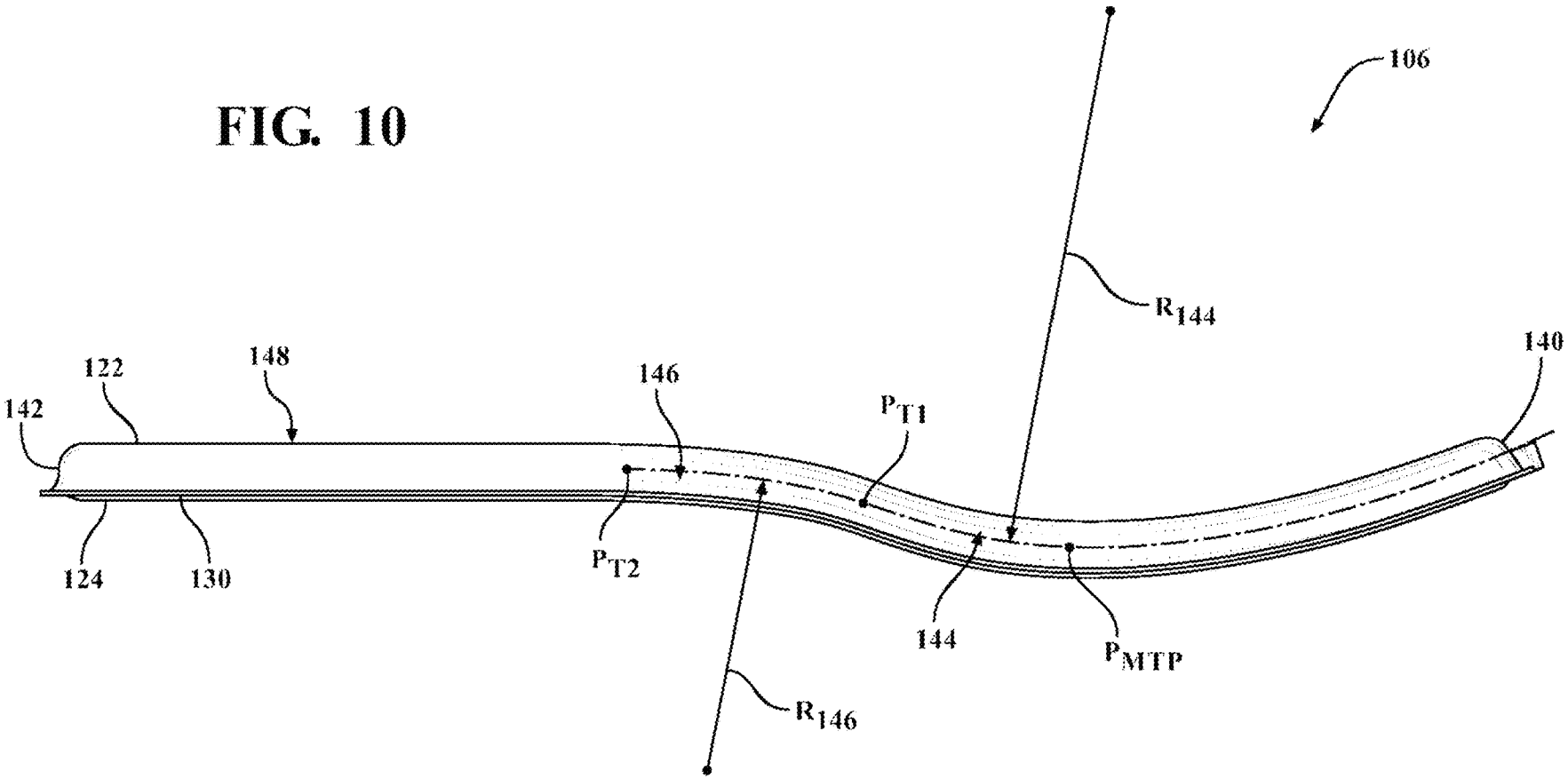
FIG. 10 is a lateral side elevation view of an example of a bladder of the sole structure of FIG. 1.

With reference to FIG. 10, the bladder 106 may be described as having a length extending from a first end 140 to a second end 142. When the bladder 106 is incorporated into the sole structure (FIGS. 7-9), the first end 140 defines an anterior-most point of the bladder 106 and the second end 142 defines a posterior-most point of the bladder 106. The bladder 106 further includes a first arcuate or curved portion 144 disposed adjacent to the first end 140, a second arcuate or curved portion 146 disposed adjacent to the first curved portion 144, and a substantially flat portion 148 extending from the second curved portion 146 to the second end 142. In other words, the second curved portion 146 is disposed between and connects the first curved portion 144 and the substantially flat portion 148.

Referring still to FIGS. 7-10, when the bladder 106 is incorporated into the sole structure 100, the first curved portion 144 defines a concave curvature relative to a footbed of the sole structure 100 such that the concave curvature defines a concave surface opposing the upper 300. Here, the first curved portion 144 extends from the first end 140 of the bladder 106 in the toe portion $\mathbf{12}_T$ of the forefoot region 12, through a metatarsophalangeal (MTP) point $P_{MTP}$ associated with the metatarsophalangeal joint of the foot, and to a first transition point $P_{T1}$ in the mid-foot region 14. As shown, the MTP point $P_{MTP}$ defines a lowermost point of the first curved portion 144. The first curved portion 144 may define a constant radius of curvature extending continuously from the first end 140 to the first transition point $P_{T1}$.

The second curved portion 146 defines a convex curvature relative to the footbed of the sole structure 100 (i.e., concave with respect to the ground-contacting surface 28) such that the convex curvature defines a convex surface that opposes the upper 300. As shown in FIG. 10, the second curved portion 146 extends from the first transition point $P_{T1}$ between the forefoot region 12 and the mid-foot region 14 to a second transition point $P_{T2}$ in the mid-foot region 14. Optionally, the second curved portion 146 may define a constant radius of curvature $R_{146}$ from the first transition point $P_{T1}$ to the second transition point $P_{T2}$.

The substantially flat portion 148 of the bladder 106 defines an elongate portion of the bladder 106 extending from the second transition point $P_{T2}$ to the second end 142 of the bladder 106. Thus, the substantially flat portion 148 extends from the mid-foot region 14 to the heel region 16. As discussed in greater detail below, when the bladder 106 is incorporated into the sole structure 100, the substantially flat portion 148 extends to and is exposed at the posterior end 20 of the sole structure 100 through an opening or gap formed between the upper chassis 110 and the lower chassis 112.

As best shown in FIGS. 3A-4, the bladder 106 may include a peripheral rib 150 extending continuously along an outer perimeter of the bladder 106. Here, the peripheral rib 150 is defined by a portion of the bladder 106 adjacent to the peripheral seam 130 having a greater thickness $T_{150}$ (FIG. 9) than a thickness $T_{152}$ of an interior portion 152 of the bladder 106 associated with the tensile element 132. In the illustrated example, the peripheral rib 150 is continuous and completely bounds the outer periphery of the bladder 106. Thus, the peripheral rib 150 is associated with a portion of the bladder 106 that defines the peripheral surface 126.

Referring now to FIGS. 1-4, the bladder 106 of the midsole 102 is disposed within the chassis 108 between the upper chassis 110 and the lower chassis 112. As discussed in greater detail below, the chassis 108 includes a combination of components of the midsole 102 and the outsole 104. Particularly, the midsole 102 may be described as including an upper cushioning element 114 and a lower cushioning element 116, while the outsole 104 may be described as including a forefoot outsole segment 118 and one or more heel outsole segments **120*a*, 120*b*. The upper cushioning element 114 forms the upper chassis 110, whereby the upper cushioning element 114 and the upper chassis 110, as well as features thereof, may be referred to interchangeably. Conversely, the lower cushioning element 116 cooperates with the forefoot outsole segment 118 to form the lower chassis 112. Thus, while the midsole 102 and the outsole 104 are provided as independent subassemblies each including a plurality of midsole components 114, 116 and outsole components 118, 120*a*, 120*b*, the individual components of the midsole 102 and the outsole 104 also cooperate with each other to define at least the lower chassis 112**.

The upper cushioning element 114 extends from a first end 156 at the anterior end 18 of the sole structure 100 to a second end 158 at the posterior end 20 of the sole structure 100. The upper cushioning element 114 includes a top side 160 configured to face the upper 300 and define the footbed of the article of footwear 10. The upper cushioning element 114 further includes a lower side 162 disposed on an opposite side from the top side 160 (i.e., facing away from the upper 300) and configured to interface with the upper barrier layer 122 of the bladder 106. A peripheral side surface 164 of the upper cushioning element 114 extends between the top side 160 and the lower side 162 and defines a peripheral profile of the upper cushioning element 114.

As best shown in FIG. 4, the lower side 162 of the upper cushioning element 114 includes an upper toe pad 166 disposed at the first end 156 and an upper pocket 168 extending between the upper toe pad 166 and the second end 158. The upper toe pad 166 may be described as having a thickness depending or protruding from the lower side 162 and having a length extending along the peripheral side surface 164 around the first end 156 of the upper cushioning element 114, from a first end on the medial side 22 to a second end on the lateral side 24. Thus, when the sole structure 100 is assembled, the upper toe pad 166 encompasses the first end 140 of the bladder 106 and defines an anterior end of the upper pocket 168.

Figure 2:
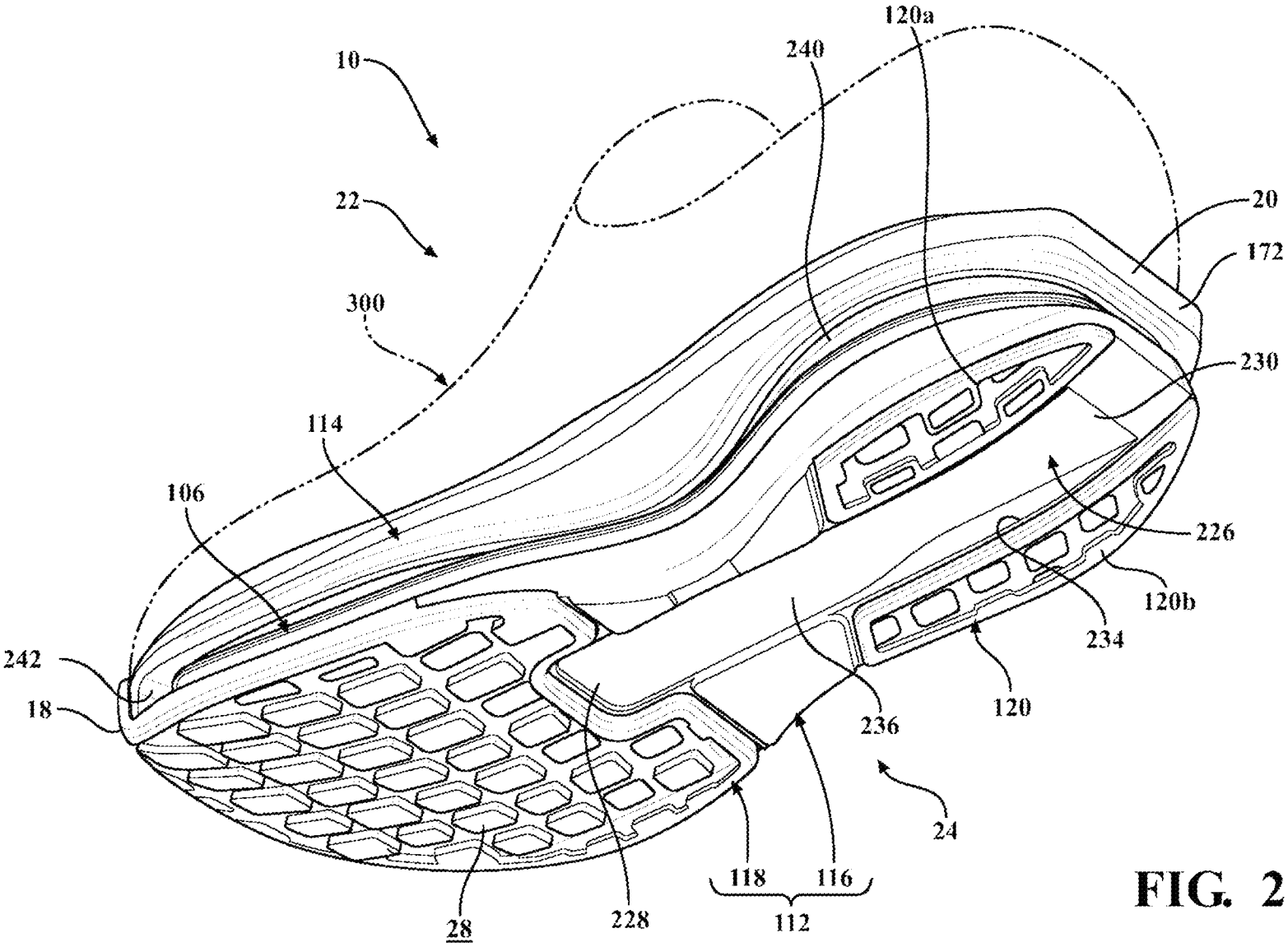
FIG. 2 is a medial side perspective view of the article of footwear of FIG. 1.

The upper pocket 168 is generally configured to interface with or receive the upper barrier layer 122 of the bladder 106. In the illustrated example, the upper pocket 168 includes an upper peripheral groove 170 extending continuously along a periphery of the upper pocket 168. The upper peripheral groove 170 has a profile (e.g., size, shape) corresponding to a profile of a portion of the peripheral rib 150 defined by the upper barrier layer 122 such that the upper peripheral groove 170 is configured to receive an upper portion of the peripheral rib 150 when the sole structure 100 is assembled. Referring to FIGS. 1 and 2, the peripheral side surface 164 of the upper cushioning element 114 includes a peripheral flange 172 that extends outwardly from the peripheral side surface 164. A distance across the peripheral flange 172 from the medial side 22 to the lateral side 24 defines an overall width $W_{114}$ of the upper cushioning element 114, which is greater than corresponding overall widths $W_{104}$, $W_{106}$, $W_{116}$ of the outsole 104, the bladder 106, and the lower cushioning element 116 in the forefoot region 12, the mid-foot region 14, and the heel region 16. Additionally, the peripheral flange 172 extends beyond the bladder 106, the lower cushioning element 116, and the outsole 104 at the posterior end 20 of the sole structure 100. The peripheral flange 172 may be flat or blunted at the posterior end 20. Thus, as best illustrated in FIGS. 7-9, the peripheral flange 172 of the upper cushioning element 114 is cantilevered with respect to the bladder 106 and the lower chassis 112 in the forefoot region 12 and the heel region 16.

With continued reference to FIG. 3B, the lower chassis 112 is shown in an assembled state and includes the lower cushioning element 116 and the forefoot outsole segment 118 of the outsole 104. The lower chassis 112 extends from a first end 174 at the anterior end 18 of the sole structure 100 to a second end 176 at the posterior end 20 of the sole structure 100. The lower chassis 112 includes an upper side 178 configured to face the bladder 106 and a bottom side 180 disposed on an opposite side from the upper side 178 (i.e., facing away from the upper 300) and configured to face a ground surface. A peripheral side surface 182 extends between the upper side 178 and the bottom side 180 and defines a peripheral profile of the lower chassis 112.

As best shown in FIG. 3B, the upper side 178 of the lower chassis 112 includes a peripheral rim 183 protruding from the upper side 178 along the peripheral side surface 182 and extending continuously around an outer periphery of the upper side 178. Accordingly, the peripheral rim 183 and the upper side 178 cooperate to define a lower pocket 184 extending from the first end 174 of the lower chassis 112 to the second end 176 of the lower chassis 112. When the sole structure 100 is assembled, the peripheral rim 183 cooperates with the upper toe pad 166 of the upper cushioning element 114 to provide a solid cushioning element in the toe portion $12_T$ of the sole structure 100. Accordingly, the peripheral rim 183 forms a lower toe pad at the anterior end 18 of the sole structure 100

The lower pocket 184 is generally configured to receive the lower barrier layer 124 of the bladder 106. In the illustrated example, the lower pocket 184 includes a lower peripheral groove 186 extending continuously along a periphery of the lower pocket 184, adjacent to the peripheral rim 183. The lower peripheral groove 186 has a profile (e.g., size, shape) corresponding to a profile of a portion of the peripheral rib 150 defined by the lower barrier layer 124 such that the lower peripheral groove 186 is configured to receive a lower portion of the peripheral rib 150 when the sole structure 100 is assembled.

As discussed above, the lower chassis 112 is defined by the cooperation of the lower cushioning element 116 of the midsole 102 and the forefoot outsole segment 118 of the outsole 104. Particularly, the lower cushioning element 116 is attached or connected to the forefoot outsole segment 118 of the outsole 104 at a lower chassis joint 188 disposed in the forefoot region 12. As discussed in greater detail below, the lower chassis joint 188 is formed as a lap joint in the forefoot region 12, where a posterior portion of the forefoot outsole segment 118 of the outsole 104 overlaps with an anterior portion of the lower cushioning element 116. The lower chassis joint 188 extends in a lateral direction across the sole structure 100 from the medial side 22 to the lateral side 24. In the illustrated example, the lower chassis joint 188 is formed between the MTP point $P_{MTP}$ of the forefoot region 12 and the mid-foot region 14. Thus, the forefoot outsole segment 118 of the outsole 104 extends from the anterior end 18, past the MTP point $P_{MTP}$, and to the lower chassis joint 188 adjacent to the mid-foot region 14. Accordingly, the outsole 104 directly supports the bladder 106 between the anterior end 18 and the lower chassis joint 188 while the lower cushioning element 116 directly supports the bladder 106 between the lower chassis joint 188 and the posterior end 20.

Referring back to FIGS. 3A-4, a length of the forefoot outsole segment 118 of the outsole 104 extends from a first end 190 at the anterior end 18 to a second end 192 at the lower chassis joint 188. The forefoot outsole segment 118 further includes an upper side 194 that defines a first portion of the upper side 178 of the lower chassis 112, a bottom side 196 formed on an opposite side from the upper side 194 and defining a first portion of the bottom side 180 of the lower chassis 112, and a peripheral side surface 198 extending between the upper side 194 and the bottom side 196 and defining a peripheral profile of the forefoot outsole segment 118. The upper side 194 of the forefoot outsole segment 118 of the outsole 104 defines an anterior portion 200 of the lower pocket 184, referred to hereinafter as the anterior lower pocket portion 200. As best shown in FIGS. 3A and 3B, the anterior lower pocket portion 200 includes an anterior portion of the lower peripheral groove 186, referred to hereinafter as the anterior lower peripheral groove portion 202. The anterior lower pocket portion 200 and the anterior lower peripheral groove portion 202 receive and support an anterior portion of the bladder 106 between the anterior end 18 and the lower chassis joint 188.

The second end 192 of the forefoot outsole segment 118 of the outsole 104 defines a first chassis joint flange 204 configured to interface with an anterior portion of the lower cushioning element 116 to form the lower chassis joint 188. In the illustrated example, the first chassis joint flange 204 extends from and is flush with the bottom side 196 of the forefoot outsole segment 118 and defines a portion of the ground-contacting surface 28 of the sole structure 100. A top side of the first chassis joint flange 204 is offset relative to the upper side 194 of the forefoot outsole segment 118 to define a stepped relationship between the first chassis joint flange 204 and the upper side 194. Optionally, the first chassis joint flange 204 may include a notch 206 formed in an intermediate portion at the second end 192, whereby the notch 206 results in an independent pair of tabs 207 on opposite sides of the first chassis joint flange 204.

Referring still to FIGS. 3A-4, a length of the lower cushioning element 116 of the midsole 102 extends from a first end 208 at the lower chassis joint 188 to a second end 210 at the posterior end 20. The lower cushioning element 116 further includes an upper side 212 that defines a second portion of the upper side 178 of the lower chassis 112, a bottom side 214 formed on an opposite side from the upper side 212 and defining a second portion of the bottom side 180 of the lower chassis 112, and a peripheral side surface 198 extending between the upper side 212 and the bottom side 214 and defining a peripheral profile of the lower cushioning element 116. The upper side 212 of the lower cushioning element 116 defines a posterior portion 218 of the lower pocket 184, referred to hereinafter as the posterior lower pocket portion 218. As best shown in FIGS. 3A and 3B, the posterior lower pocket portion 218 includes a posterior portion of the lower peripheral groove 186, referred to hereinafter as the posterior lower peripheral groove portion 220. The posterior lower pocket portion 218 and the posterior lower peripheral groove portion 220 receive and support a posterior portion of the bladder 106 between the lower chassis joint 188 and the posterior end 20.

The first end 208 of the lower cushioning element 116 defines a second chassis joint flange 222 configured to interface with the first chassis joint flange 204 of the forefoot outsole segment 118 of the outsole 104 to form the lower chassis joint 188. In the illustrated example, the second chassis joint flange 222 extends from and is flush with the upper side 212 of the lower cushioning element 116 and defines a portion of the posterior lower pocket portion 218. A bottom side of the second chassis joint flange 222 is offset relative to the bottom side 214 of the lower cushioning element 116 to define a stepped relationship between the second chassis joint flange 222 and the bottom side 214.

Referring to FIG. 7, when the sole structure 100 is assembled, the first chassis joint flange 204 and the second chassis joint flange 222 interface with each other to form a lap joint between the forefoot outsole segment 118 of the outsole 104 and the lower cushioning element 116. Particularly, the lower chassis joint 188 may be referred to as a half lap joint, whereby the stepped chassis joint flanges 204, 222 are configured such that the upper sides 194, 212 are flush and continuous with each other to define the upper side 178 of the lower chassis 112 and the lower sides 196, 214 are flush and continuous with each other to define the bottom side 180 of the lower chassis 112.

Referring now to FIGS. 4 and 6, the lower cushioning element 116 includes a longitudinal heel channel 226 formed in the bottom side 214. The longitudinal heel channel 226 extends from a first channel end 228 adjacent to the first end 208 of the lower cushioning element 116 to a second channel end 230 adjacent to or coincident with the second end 210 of the lower cushioning element 116. A width $W_{226}$ of the heel channel 226 is defined by a medial channel wall 232 and a lateral channel wall 226 each extending from the first channel end 228 to the second channel end 230. As shown in FIG. 6, the width $W_{226}$ of the heel channel 226 is constant from the first channel end 228 to the second channel end 230. Referring to FIG. 7, a depth $D_{226}$ of the heel channel 226 is measured from the bottom side 214 of the lower cushioning element 116 to an upper channel surface 236. In the illustrated example, the depth $D_{226}$ of the heel channel 226 is greater in the heel region 16 than in the mid-foot region 14 to provide increased clearance for compressing the heel region 16 during a heel strike. Thus, the heel channel 226 provides the lower cushioning element 116 with a trampoline-like function, allowing the lower cushioning element 116 to flex beneath the calcaneus bone of the foot during a heel strike.

With continued reference to FIGS. 1, 2, and 6-9, when the sole structure 100 is assembled, an upper surface of the bladder 106 defined by the upper barrier layer 122 is attached to the upper cushioning element 114 within an interior region associated with the upper pocket 168 such that the peripheral surface 126 of the bladder 106 (i.e., the portion extending between the upper and lower surfaces defined by the barrier layers 122, 124) is inwardly offset from the peripheral side surface 164 of the upper cushioning element 114. In other words, the upper cushioning element 114 may be described as including the peripheral flange 172 that overhangs or extends outwardly from the peripheral surface 126 of the bladder 106. Likewise, a lower surface of the bladder 106 defined by the lower barrier layer 124 is attached to the lower chassis 112 within an interior region associated with the lower pocket 184 such that the peripheral surface 126 of the bladder 106 is adjacent to the peripheral side surface 182 of the lower cushioning element 116. Thus, the upper cushioning element 114 (i.e., the upper chassis 110) is cantilevered relative to the bladder 106 along the medial side 22, the lateral side 24, and at the posterior end 20, while the lower chassis 112 is substantially flush with the peripheral side surface 182 of the lower chassis 112 along the medial side 22, the lateral side 24, and at the posterior end 20.

As shown in the figures, the lower side surface 182 of the lower chassis 112 is spaced apart from the peripheral flange 172 of the upper chassis 110 to define a peripheral channel 240 of the chassis 108 that extends continuously along the sole structure 100 from a first end 242 defined by the upper toe pad 166 on the medial side 22, around the second end 142 of the bladder 106, and to a second end 244 defined by the toe pad 166 on the lateral side 24. Thus, upper chassis 110 and the lower chassis 112 are not directly attached to each other in the ball portion $12_B$, the mid-foot region 14, or the heel region 16. Instead, in these regions of the sole structure 100, the bladder 106 provides the only interface between the upper chassis 110 and the lower chassis 112. By utilizing the bladder 106 as the support interface between the upper chassis 110 and the lower chassis 112, the sole structure 100 provides a relatively high degree of lateral compliance by allowing the upper chassis 110 to shift independently from the lower chassis 112 in the mid-foot region 14 and the heel region 16. Further, by configuring the bladder 106 with an unconstrained peripheral surface 126, the bladder 106 may provide improved cushioning by allowing the peripheral surface 115 to expand or distend into the peripheral channel 240 under compressive loads.

As described above, the cushioning elements 114, 116 include a resilient polymeric material, such as foam or rubber, to impart properties of cushioning, responsiveness, and energy distribution to the foot of the wearer. Example resilient polymeric materials for the cushioning elements 114, 116 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layers 122, 124. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

In addition to the forefoot outsole segment 118, the outsole 104 includes a pair of heel outsole segments 120*a*, 120*b* attached to the bottom side 214 of the lower cushioning element 116 on opposite sides of the heel channel 226. The outsole segments 118, 120*a*, 120*b* are formed of a different material than the cushioning elements 114, 116. Particularly, the outsole segments 118, 120*a*, 120*b* include a rubber material having a greater coefficient of friction and abrasion resistance than the material of the cushioning elements 114, 116.

The upper 300 is attached to the sole structure 100 and includes interior surfaces that define an interior void configured to receive and secure a foot for support on the sole structure 100. The upper 300 may be formed from one or more materials that are stitched or adhesively bonded together to form the interior void. Suitable materials of the upper 300 may include, but are not limited to, mesh, textiles, foam, leather, and synthetic leather. The materials may be selected and located to impart properties of durability, air-permeability, wear-resistance, flexibility, and comfort.

The following Clauses provide exemplary configurations for an article of footwear, a bladder for an article of footwear, or a sole structure for an article of footwear described above.

Clause 1. A sole structure for an article of footwear, the sole structure defining a footbed and comprising a bladder extending from a first end in a forefoot region of the sole structure to a second end in a heel region of the sole structure and a chassis including a lower chassis having a first outsole segment attached to the bladder in the forefoot region and a lower cushioning element attached to the bladder in the heel region.

Clause 2. The sole structure of Clause 1, wherein the lower chassis defines an upper chassis surface extending continuously from the forefoot region to the heel region and supporting the bladder.

Clause 3. The sole structure of Clause 2, wherein a first portion of the upper chassis surface is defined by the first outsole segment and a second portion of the upper chassis surface is defined by the lower cushioning element.

Clause 4. The sole structure of any of the preceding Clauses, wherein the lower cushioning element includes a lateral joint connecting the lower cushioning element to the first outsole segment.

Clause 5. The sole structure of Clause 4, wherein the lateral joint is disposed between the forefoot region and a mid-foot region of the sole structure.

Clause 6. The sole structure of Clause 4, wherein the lower cushioning element overlaps the first outsole segment along the lateral joint.

Clause 7. The sole structure of any of the preceding Clauses, wherein the bladder includes a first curved portion in a forefoot region of the sole structure and a substantially flat portion in the heel region of the sole structure.

Clause 8. The sole structure of Clause 1, wherein the chassis includes an upper chassis disposed on an opposite side of the bladder from the lower chassis.

Clause 9. A sole structure for an article of footwear, the sole structure defining a footbed and comprising a lower chassis having a first outsole segment defining a first portion of an upper chassis surface in a forefoot region of the sole structure and a lower cushioning element attached to the first outsole segment and defining a second portion of the upper chassis surface in at least one of a mid-foot region and a heel region of the sole structure and a bladder supported on the upper chassis surface and extending from a first end in the forefoot region of the sole structure to a second end in the heel region of the sole structure.

Clause 10. The sole structure of Clause 9, wherein the upper chassis surface extends continuously from the forefoot region to the heel region and supports the bladder.

Clause 11. The sole structure of Clause 9 or 10, wherein the lower cushioning element includes a lateral joint connecting the lower cushioning element to the first outsole segment.

Clause 12. The sole structure of Clause 11, wherein the lateral joint is disposed between the forefoot region and the mid-foot region of the sole structure.

Clause 13. The sole structure of Clause 11, wherein the lower cushioning element overlaps the first outsole segment along the lateral joint.

Clause 14. The sole structure of any of the preceding Clauses, wherein the bladder includes a first curved portion in the forefoot region of the sole structure and a substantially flat portion in the heel region of the sole structure.

Clause 15. The sole structure of any of the preceding Clauses, further comprising an upper chassis disposed on an opposite side of the bladder from the lower chassis.

Clause 16. A sole structure for an article of footwear, the sole structure defining a footbed and comprising a first outsole segment having a first side defining a first portion of an upper chassis surface in a forefoot region of the sole structure and a second side formed on an opposite side from the first side and defining a first portion of a ground-contacting surface of the sole structure, a lower cushioning element attached to the first outsole segment and having (i) a third side defining a second portion of the upper chassis surface in at least one of a mid-foot region and a heel region and (ii) a fourth side formed on an opposite side of the lower cushioning element from the third side, and a bladder supported on the upper chassis surface and extending from a first end in the forefoot region of the sole structure to a second end in one of the mid-foot region or the heel region of the sole structure.

Clause 17. The sole structure of Clause 16, wherein the upper chassis surface extends continuously from the forefoot region to the heel region and supports the bladder.

Clause 18. The sole structure of Clause 16 or 17, wherein the lower cushioning element includes a lateral joint connecting the lower cushioning element to the first outsole segment.

Clause 19. The sole structure of any of the preceding Clauses, further comprising an upper cushioning element disposed on an opposite side of the bladder from the lower cushioning element and the first outsole segment.

Clause 20. The sole structure of Clause 19, further comprising a second outsole segment attached to the fourth side of the lower cushioning element and defining a second portion of the ground-contacting surface of the sole structure in the heel region.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure defining a footbed and comprising: a bladder extending from a medial side of the sole structure to a lateral side of the sole structure along an entire length of the bladder from a first end in a forefoot region of the sole structure to a second end in a heel region of the sole structure; and a chassis including a lower chassis having (i) a first outsole segment directly attached to the bladder in the forefoot region and (ii) a lower cushioning element attached to the first outsole segment and attached to the bladder in the heel region.

2. The sole structure of claim 1, wherein the lower chassis defines an upper chassis surface extending continuously from the forefoot region to the heel region and supporting the bladder.

3. The sole structure of claim 2, wherein a first portion of the upper chassis surface is defined by the first outsole segment and a second portion of the upper chassis surface is defined by the lower cushioning element.

4. The sole structure of claim 1, wherein the lower cushioning element includes a lateral joint connecting the lower cushioning element to the first outsole segment.

5. The sole structure of claim 4, wherein the lateral joint is disposed between the forefoot region and a mid-foot region of the sole structure.

6. The sole structure of claim 4, wherein the lower cushioning element overlaps the first outsole segment along the lateral joint.

7. The sole structure of claim 1, wherein the bladder includes a first curved portion in a forefoot region of the sole structure and a substantially flat portion in the heel region of the sole structure.

8. The sole structure of claim 1, wherein the chassis includes an upper chassis disposed on an opposite side of the bladder from the lower chassis.

9. A sole structure for an article of footwear, the sole structure defining a footbed and comprising:

a lower chassis having a first outsole segment defining a first portion of an upper chassis surface in a forefoot region of the sole structure and a lower cushioning element attached to the first outsole segment and defining a second portion of the upper chassis surface in at least one of a mid-foot region and a heel region of the sole structure; and a bladder supported on the upper chassis surface and directly attached to the first outsole segment in the forefoot region, the bladder extending from a medial side of the sole structure to a lateral side of the sole structure along an entire length of the bladder from a first end in the forefoot region of the sole structure to a second end in the heel region of the sole structure.

10. The sole structure of claim 9, wherein the upper chassis surface extends continuously from the forefoot region to the heel region and supports the bladder.

11. The sole structure of claim 9, wherein the lower cushioning element includes a lateral joint connecting the lower cushioning element to the first outsole segment.

12. The sole structure of claim 11, wherein the lateral joint is disposed between the forefoot region and the mid-foot region of the sole structure.

13. The sole structure of claim 11, wherein the lower cushioning element overlaps the first outsole segment along the lateral joint.

14. The sole structure of claim 9, wherein the bladder includes a first curved portion in the forefoot region of the sole structure and a substantially flat portion in the heel region of the sole structure.

15. The sole structure of claim 9, further comprising an upper chassis disposed on an opposite side of the bladder from the lower chassis.

16. A sole structure for an article of footwear, the sole structure defining a footbed and comprising:

a first outsole segment having a first side defining a first portion of an upper chassis surface in a forefoot region of the sole structure and a second side formed on an opposite side from the first side and defining a first portion of a ground-contacting surface of the sole structure;

a lower cushioning element attached to the first outsole segment and having (i) a third side defining a second portion of the upper chassis surface in at least one of a mid-foot region and a heel region and (ii) a fourth side formed on an opposite side of the lower cushioning element from the third side; and a bladder supported on the upper chassis surface and directly attached to the first outsole segment in the forefoot region, the bladder extending from a medial side of the sole structure to a lateral side of the sole structure along an entire length of the bladder from a first end in the forefoot region of the sole structure to a second end in one of the mid-foot region or the heel region of the sole structure.

17. The sole structure of claim 16, wherein the upper chassis surface extends continuously from the forefoot region to the heel region and supports the bladder.

18. The sole structure of claim 16, wherein the lower cushioning element includes a lateral joint connecting the lower cushioning element to the first outsole segment.

19. The sole structure of claim 16, further comprising an upper cushioning element disposed on an opposite side of the bladder from the lower cushioning element and the first outsole segment.

20. The sole structure of claim 19, further comprising a second outsole segment attached to the fourth side of the lower cushioning element and defining a second portion of the ground-contacting surface of the sole structure in the heel region.

* * * * *